United States Patent [19]

Skogward

[11] Patent Number: 4,762,077

[45] Date of Patent: Aug. 9, 1988

[54] ARRANGEMENT OF A CLOTH FEEDER IN A SEWING MACHINE

[75] Inventor: Kenneth O. E. Skogward, Huskvarna, Sweden

[73] Assignee: Husqvarna Aktiebolag, Sweden

[21] Appl. No.: 22,131

[22] Filed: Mar. 5, 1987

[30] Foreign Application Priority Data

Mar. 11, 1986 [SE] Sweden ..... 8601129

[51] Int. Cl.[4] ..... D05B 27/02

[52] U.S. Cl. ..... 112/323

[58] Field of Search ..... 112/303, 314, 317, 319, 112/323

[56] References Cited

U.S. PATENT DOCUMENTS 4,120,254 10/1978 Herr et al. ..... 112/323 X
4,235,180 11/1980 Weisz ..... 112/323
4,512,273 4/1985 Skogward ..... 112/323 X
4,513,678 4/1985 Skogward ..... 112/323
4,633,796 1/1987 Hoffman-Glewe et al. ..... 112/314

*Primary Examiner*—H. Hampton Hunter
*Attorney, Agent, or Firm*—Alfred E. Miller

[57] ABSTRACT

Modern sewing machines comprise an automatic control of cloth feeding in a form of a guide mechanism or a link mechanism. This invention solves the problem of the several points of play in the guide and link mechanisms by substituting a linear driving motor (12) for these mechanisms, which motor drives the feeder directly in a linear movement without intervening mechanical transmission. The number of parts has been essentially reduced by this solution. The vertical movement of the feeder is brought about by a curve disc (22) driven by the sewing machine motor or by a separate motor for the vertical movement. The longitudinal and the vertical movements are synchronized to the other functions in other units of the sewing machine in an electrical or combined electronical/mechanical way.

7 Claims, 1 Drawing Sheet

ARRANGEMENT OF A CLOTH FEEDER IN A SEWING MACHINE

The present invention relates to a cloth feeder arrangement in a sewing machine, preferably an electronic machine wherein control of the feeding movement is effected by a computer disposed in the machine.

Modern sewing machines comprise an automatic control of the feeding including some kind of a guide and/or link mechanism having a lot of members which are difficult and expensive to manufacture in order to make them keep a good accuracy of the movement. Moreover, the mechanism has a large number of connections between the members which can give rise to play. Some of these members also make a gearing up of the movement whereby a fault is enlarged on the way to the feeder.

By the present invention the problem of the occurrence of several points of play in previously used mechanisms is solved by providing a linear driving motor in lieu of the mechanism, thus driving the feeder directly in a linear movement without an intervening transmission. Moreover, the number of members has been greatly reduced by this solution which brings about a simpler and cheaper design. However, the feeding movement must be synchronized with the needle movement, either in an electrical or combined electronical/-mechanical way.

An embodiment of the invention will be described in the following with reference to the accompanying drawing which shows in FIG. 1 the feeding device in a horizontal projection in the free arm of a sewing machine and FIG. 2 a modification of the feeding device in a perspective view.

Figure 1:
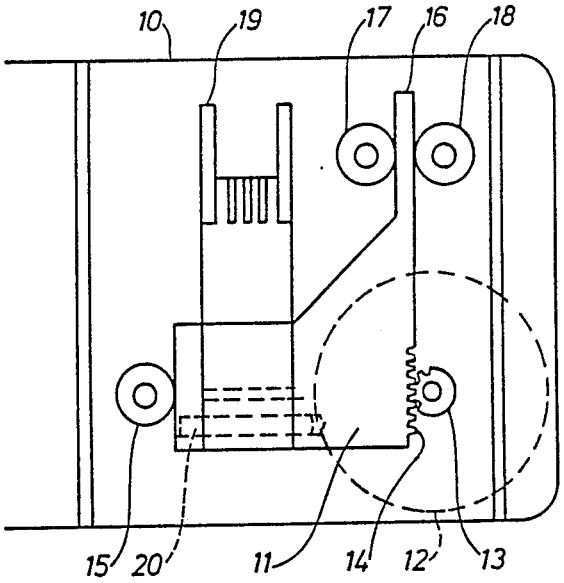
Figure 2:
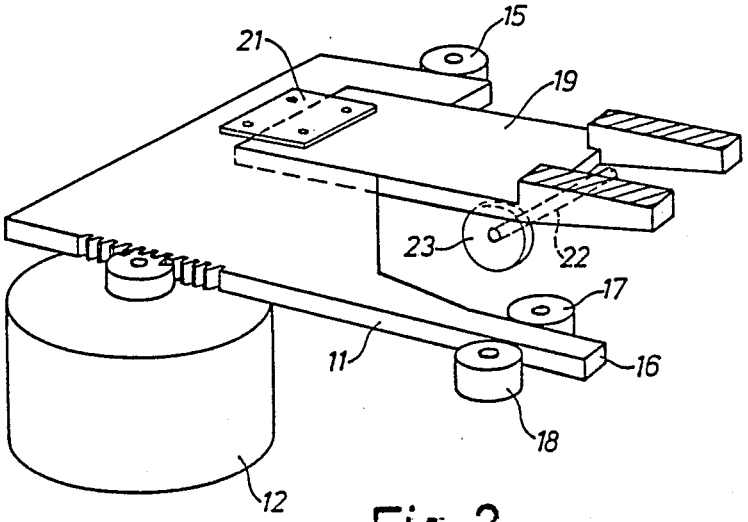

In FIG. 1 the device is schematically shown in the end of the free arm 10 of the sewing machine, the top surface of the arm is removed. A guide 11 is journalled and mounted below said top surface by means of supports in the top surface. The guide is thus movable in the transverse direction of the free arm, i.e. it is movable in the feeding direction of the machine. The movement is achieved by a stepping motor 12 which is secured in the free arm and has a pinion 13 which meshes with a rack 14 on the guide. The pinion and the rack have a pretension against each other by means of a counter pressure roller 15, whereby the play in the gear is eliminated. Guiding rollers 17, 18 engage opposite sides of a tongue 16 of the guide, whereby the position of the guide is well defined.

A feeder 19 is provided on the guide and fastened on a shaft 20 mounted on the guide 11 (FIG. 1) or by means of a blade spring 21 (FIG. 2) so that the feeder can move up and down. The movement is effected by a cam disc 23 on a shaft 22 below the feeder and the power is obtained from the main shaft of the machine or from a separate motor for the vertical movement (not shown). The feeder is forced up to the working material on the stitch plate by the cam disc and returned in the opposite direction by the spring 21. It is suitable to have a pretension on the blade spring 21 giving the feeder a constant contact to the cam disc.

It is also possible to provide another transmission between the motor and the guide than the shown gearing, e.g. an eccentric drive arrangement, whereby the pinion 13 on the shaft is replaced by an eccentric disc and a rectangular aperture in the guide is substituted for the rack. The eccentric disc engages the edges of the aperture to move the guide.

Characteristic of the device is also that it occupies small space in the vertical direction. Thus, it leaves sufficient space for the shuttle mechanism at the side of the stepping motor. It is, of course, possible to find alternative positions to the components of the device. The shown embodiment is only a practical example.

What is claimed is:

1. In a cloth feeding apparatus for a sewing machine comprising a reciprocating guide, a vertically movable feeder on said guide, and means for driving said guide, the improvement wherein said guide and feeder comprise substantially planar elements, and wherein said driving means comprises a motor having a shaft, and a pinion mounted to be driven by said shaft, said pinion being mounted to directly drive said guide and also to support said guide.

2. The cloth feeding apparatus of claim 1 wherein said pinion is mounted on said shaft.

3. The cloth feeding apparatus of claim 1 wherein a rack is formed in said guide, and said pinion meshes with said rack.

4. The cloth feeding apparatus of claim 1 further comprising a rotatable cam disc for vertically moving said feeder.

5. The cloth feeding apparatus of claim 4 further comprising an elastic member mounting said feeder on said guide and biasing said feeder against said cam disc.

6. The cloth feeding apparatus of claim 1 wherein said feeder is pivotally mounted to said guide.

7. The cloth feeding apparatus of claim 8 wherein said motor is a stepping motor.

* * * * *